United States Patent [19]

Hutchison

[11] Patent Number: 4,815,930

[45] Date of Patent: Mar. 28, 1989

[54] CAVITATING CENTRIFUGAL PUMP

[75] Inventor: Richard M. Hutchison, Rockford, Ill.

[73] Assignee: Sundstrand Corporation, Rockford, Ill.

[21] Appl. No.: 184,819

[22] Filed: Apr. 22, 1988

[51] Int. Cl.[4] ..... F01D 1/00

[52] U.S. Cl. ..... 415/117; 415/121 A

[58] Field of Search ..... 415/116, 117, 121 A, 415/168

[56] References Cited

U.S. PATENT DOCUMENTS

| | | | |
|---|---|---|---|
| 923,680 | 6/1909 | Meyersberg | 415/117 |
| 2,381,823 | 8/1945 | La Bour | 416/168 |

*Primary Examiner*—Robert E. Garrett
*Assistant Examiner*—John T. Kwon
*Attorney, Agent, or Firm*—Wood, Dalton, Phillips, Mason & Rowe

[57] ABSTRACT

A cavitating centrifugal pump which includes a housing defining a pumping chamber. An impeller is rotatable in the pumping chamber and includes a plurality of impeller blades designed for forming trailing vapor cavities within a liquid in the chamber to generate low pressure regions behind the blades upon rotation of the impeller. A fluid inlet is provided to the chamber radially inwardly of the low pressure regions and in communication therewith. A fluid outlet is provided from the chamber radially outwardly of the fluid inlet and in an area of the chamber whereby the fluid can be pumped from the chamber. Liquid inlets are provided to the chamber in the area of the impeller blades for flushing the low pressure regions behind the blades.

25 Claims, 2 Drawing Sheets

CAVITATING CENTRIFUGAL PUMP

FIELD OF THE INVENTION

This invention generally relates to centrifugal pumps and, particularly, to a centrifugal pump having impeller blades which cause cavitation in a fluid.

BACKGROUND OF THE INVENTION

Centrifugal pumps have been used for many years to move or pump fluids, usually liquids or a liquid-gas mixture. For instance, scavenging pumps are widely used in hydromechanical power systems for scavenging liquids, such as oil, used for lubricating and/or cooling components of the system.

However, scavenging of a fluid which has a high air-to-oil ratio mixture (e.g. 4:1 and up) continues to be a problem for such positive displacement pumps because of the carry-over of air from the discharge to the inlet and from leakage. Centrifugal pumps work quite well for pumping substantially 100% liquid, such as oil. But an impeller which is designed to pump oil generally will not pump air or pump a high air-to-oil mixture efficiently.

The problem arises from cavitation created behind the rotating impeller blades. In high speed centrifugal pumps, this commonly is called supercavitation. In other words, a centrifugal pump normally includes a housing defining a pumping chamber within which an impeller structure rotates. The chamber generally is cylindrical or of a contour complementary to the contour of the impeller blades. A fluid inlet is provided to the chamber at a radially inward location in relation to a radially outward location for an outlet from the chamber through which the fluid is pumped. As the impeller structure rotates at a high speed, cavitation occurs behind the impeller blades. In essence, cavitation is caused by vapor cavities formed on the trailing side of the blades as they rotate at high speed. The cavities generally are at the vapor pressure of the liquid being pumped. This phenomena is akin to an object, such as a projectile, passing through water at a high rate of speed. A vapor cavity is formed behind the projectile trailing its direction of movement.

Normally, cavitation is undesirable in centrifugal pumps because the vapor cavities create a power loss, cause "pitting" damage to the surrounding chamber walls and cause backflow or carry-over of the air from the discharge to the inlet of the pump. Therefore, attempts heretofore have been made to diminish the vapor cavities by separating the air from the pumped liquid. This is accomplished by providing bleed passages from the pumping chamber to "drain" the cavities which usually form near the roots of the impeller blades because the air is lighter than the pumped liquid.

This invention is directed to a novel approach of taking advantage of the cavitation phenomenon and actually using the inherent low pressure of the vapor cavities to enhance pumping of fluids having a high air-to-liquid ratio and even fluids which may be substantially gas.

SUMMARY OF THE INVENTION

An object, therefore, of the invention is to provide a new and improved cavitating centrifugal pump of the character described.

In the exemplary embodiment of the invention, generally, a centrifugal pump is contemplated with a pump housing defining a pumping chamber. An impeller is rotatably mounted in the pumping chamber and includes a plurality of impeller blades designed for forming trailing vapor cavities within a liquid in the chamber to generate low pressure regions behind the blades upon rotation of the impeller. Fluid inlet means are provided to the chamber radially inwardly of the low pressure regions and in communication therewith. Fluid outlet means are provided from the chamber radially outwardly of the inlet means and in an area of the chamber whereby the fluid can be pumped from the chamber. The invention contemplates providing liquid inlet means to the chamber in the area of the impeller blades for maintaining a liquid ring about the impeller blades and for flushing the low pressure regions behind the blades.

In other words, the invention contemplates an enhancement of the cavitation phenomenon to create substantial low pressure regions, i.e. vapor cavities, behind the rotating impeller blades, and then continuously flushing these regions with a liquid. With the fluid inlet means in communication with the low pressure regions, in combination with the continuous flushing, the vapor cavities continuously are replenished with the fluid from the inlet means to the chamber. Therefore, high gas-to-liquid ratio mixtures can be pumped and, in fact, by continuously flushing the vapor cavities, substantially 100% gas fluids can actually be pumped by the centrifugal pump of the invention, as a "dry lift" pump to purge air out of a line.

More specifically, the fluid inlet means is generally located at the axis of rotation of the impeller means. The impeller means comprises a closed construction and spiral passageways are formed through the impeller means communicating between the inlet means and the trailing low pressure regions behind the impeller blades. The liquid inlet means to the chamber comprise a plurality of liquid inlets arranged in a direction generally tangential to the path of the rotating impeller blades, the inlets entering the chamber in a direction opposite the direction of rotation of the blades. The liquid inlets preferably are equally spaced about the pumping chamber and about the rotating impeller blades so that the pump is insensitive to gravity. Otherwise, the lighter air or gas would tend to collect at the top of the pumping chamber, whatever its orientation. To this end, the fluid outlet means from the chamber preferably comprise a plurality of outlets spaced intermittently between the liquid inlets.

The impeller blades themselves are generally ramp-shaped and inclined opposite the direction of rotation thereof. The ramp-shaped impeller blades each includes an inclined outer wall terminating in a blade tip defined by a transverse distal edge of the inclined outer wall. In addition, each impeller blade is a closed structure defining an internal chute in communication between the fluid inlet means and the respective low pressure region behind the blade. This structure enhances supercavitation behind the blades at high speed rotation.

Other objects, features and advantages of the invention will be apparent from the following detailed description taken in connection with the accompanying drawings.

Brief Description Of The Drawings

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
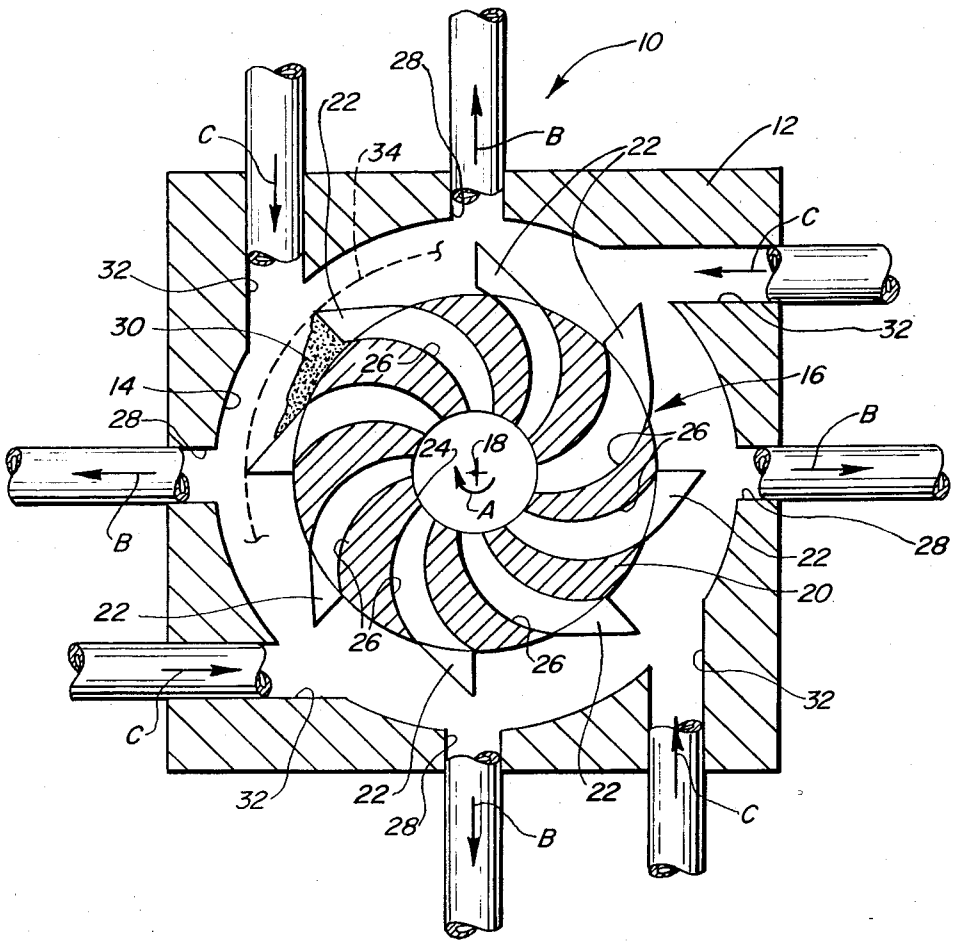
FIG. 1 is a somewhat schematic illustration of the basic components of a centrifugal pump, and incorporating the concepts of the invention.

Referring to the drawings in greater detail, and first to FIG. 1, a centrifugal pump, generally designated 10, is shown by a somewhat schematic illustration to highlight the concepts of the invention. Pump 10 would include a housing 12 defining a pumping chamber 14. The pumping chamber is shown as circular (actually, cylindrical), but the chamber may be inclined or otherwise contoured in an axial direction to conform to whatever transverse contour may be provided for the impeller blades.

Impeller means, generally designated 16, are appropriately rotatably mounted within pumping chamber 18 concentric therewith for rotation about an axis 18, in the direction of arrow "A". The impeller means include a hub 20 and a plurality of impeller blades 22 projecting radially outwardly from hub 20. Fluid inlet means 24 are provided to the pump by making hub 20 hollow about axis 18 to define an inlet which (although not shown) will be in communication with whatever location from which fluid is to be pumped. For instance, if centrifugal pump 10 is used as a scavenging pump, inlet means 24 would be in communication with a motor housing, for instance, by appropriate conduit means to scavenge lubricating/cooling oil from the motor housing.

As will be described in greater detail hereinafter, each impeller blade 22 comprises a generally hollow construction and is in communication with inlet means 24 by a respective spiral passage 26 passing interiorly through impeller hub 20.

Fluid outlet means are provided from chamber 14 radially outwardly of inlet means 24. Specifically, a plurality of outlets 28 are provided from chamber 14 radially outwardly of impeller blades 22 and through which pumped fluid passes in the direction of arrows "B". Four outlets 24 are shown generally 90° apart and through the peripheral walls of pumping chamber 14. These outlets can lead to any appropriate source, such as to a reservoir in a closed circuit scavenging pump system. The fluid then would be returned to the motor housing for lubricating/cooling purposes, whereupon it would be recycled back to pump 10 and inlet means 24. Of course, it should be understood that a scavenging pump is but one possible use for the novel centrifugal pump of the invention.

During rotation of impeller means 16 and impeller blades 22 in the direction of arrow "A", trailing vapor cavities are formed within the liquid within pumping chamber 14 to generate low pressure regions behind the blades. One such region is shown at 30 in FIG. 1 behind one of the blades in the upper left-hand quadrant of the impeller and pumping chamber. This low pressure region is effective to draw fluid through the respective passage 26 from inlet means 24 centrally of the impeller, due to the differential pressure between the inlet means and the low pressure region. It is this cavitation principle which the invention takes advantage of in effecting a pumping action with a high gas-to-liquid ratio mixture of incoming fluid. However, the low pressure regions, in and of themselves, will not effectively draw the fluid from the inlet means. The lighter air tends to migrate radially inwardly as the heavier liquid moves outwardly under centrifugal force and, as a result, these cavitation cavities tend to build up, simply causing turbulence within pumping chamber 14, and result in a loss of power as well as a back-flow of the lighter gas toward the inlet means.

The invention contemplates providing liquid inlet means to pumping chamber 14 in the area of the impeller blades for maintaining a liquid ring about the impeller blades and for flushing the low pressure regions 30 behind the blades 22. More particularly, a plurality of inlets 32 are provided through housing 12 into pumping chamber 14. It can be seen that the inlets are arranged in a direction generally tangential to the path of rotating impeller blades 22. In addition, the inlets enter the pumping chamber in a direction opposite the direction of rotation of the blades, as indicated by arrows "C". Liquid is forced into the chamber through inlets 32 from any appropriate source by a supplemental pump, such as a gear pump, not shown. In a scavenging pump system, the liquid may come from the system reservoir itself, or other areas of the system, whereupon the liquid is returned back to the system through outlets 28.

The liquid which is forced into pumping chamber 14 through inlets 32 have the effect of flushing or purging the trailing vapor cavities or low pressure regions 30 behind the rotating impeller blades. As each region approaches one of the inlets 32, the gaseous mixture or vapor within the region is forced into solution and exits with the liquid from the pumping chamber through outlets 28. When this occurs, of course, the evacuated or "flushed" space behind each blade is replenished with liquid from the pumping chamber whereupon, again, that liquid is replenished by vapor as the blades rotate at a high speed, again creating a low pressure which draws fluid from inlet means 24. Although this description sets forth a cycle of operation, it should be understood that the "flushing" of the low pressure regions 30, followed by the creation of another trailing vapor cavity, and the resultant differential pressure drawing fluid from inlet means 24, all occur extremely rapidly and continuously as the impeller means 16 rotates. Therefore, a continuous pumping of fluid from inlet means 24 is effected.

As stated briefly above, fluid is forced into pumping chamber 14 to maintain a liquid ring about impeller blades 22, along with the described flushing action. Preferably, sufficient liquid is forced into the pumping chamber through inlets 32 to maintain the liquid within the chamber at a level shown by dotted line 34 in FIG. 1. This is what is being termed a liquid ring. Preferably, the liquid level or liquid ring should cover the tips of impeller blades 22. Theoretically, if the pump fluid is a liquid/gas mixture, this precise location of the liquid ring might not be mandatory. However, if substantially pure gas is being pumped by centrifugal pump 10, through inlet 24, eventually the device would quit pumping because lighter air would migrate toward the center of impeller means 16 and simply fill all of the spaces between blades 22. Therefore, depending upon the amount of gas (e.g. air) within the incoming fluid, the liquid ring might be required to be maintained at least radially inwardly sufficient to cover the tips of blades 22.

Figure 2:
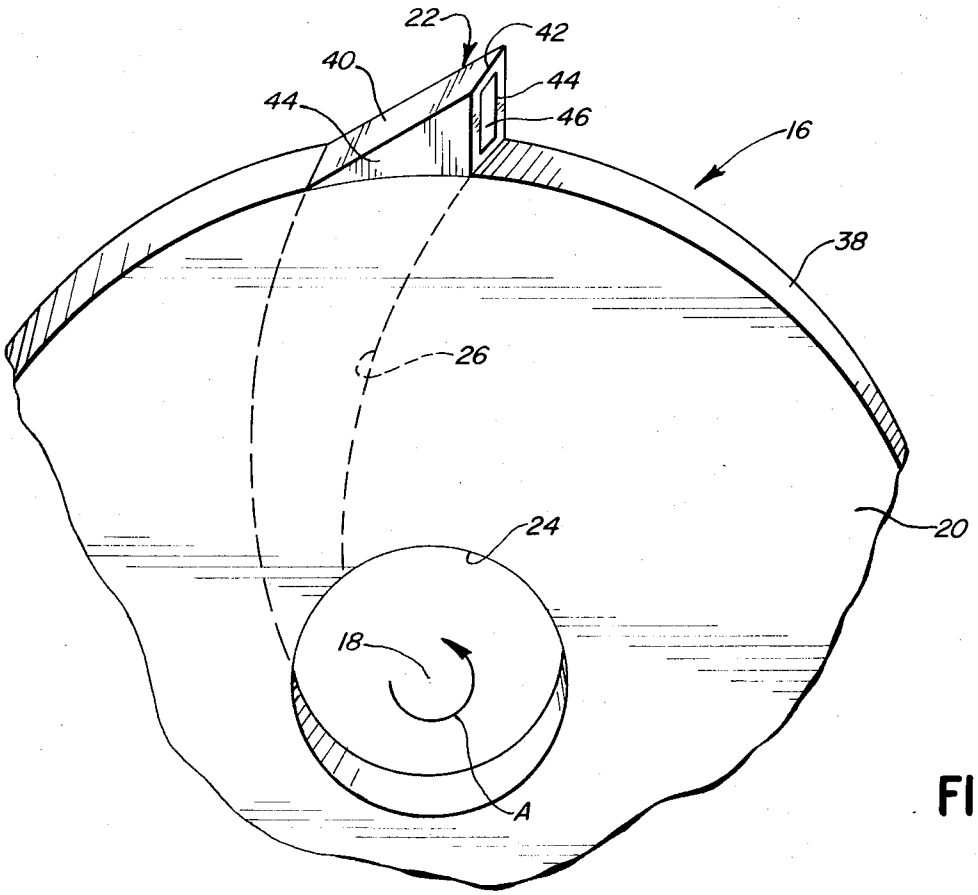
FIG. 2 is a fragmented perspective view illustrating the structure of one of the impeller blades and the communication thereof with the inlet means of the pump.

FIG. 2 shows an enlarged, fragmented perspective view of impeller means 16 to better illustrate the construction of hub 20 and each individual impeller blade 22. It should be noted that the impeller means is shown opposite that of FIG. 1, i.e. rotation is in a counterclockwise direction, versus the clockwise direction illustrated in FIG. 1. Nevertheless, the impeller means rotates in the direction of arrow "A" with fluid inlet means 24 located centrally of hub 20 concentric with axis of rotation 18. It can be seen that the impeller hub is generally disk-shaped with a cylindrical outer wall 38 defining the thickness of the hub. One of the spiral passages 26 is shown through the interior of the hub communicating between inlet means 24 and blade 22.

Each impeller blade 22 is generally ramp-shaped as best seen in FIG. 2. The ramp is inclined opposite the direction of rotation of the impeller means and includes an inclined outer wall 40 terminating in a blade tip defined by a transverse distal edge 42 of the inclined outer wall. In other words, the distal edge extends generally parallel to axis 18. The blade includes generally triangular shaped side walls 14 whereby the blade comprises a closed structure defining an internal chute 46 in communication with internal passage 26 of hub 20. Thereby, chute 46 through blade 22, in essence is in communication between fluid inlet means 24 and the low pressure region behind the blade as the blade rotates.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A centrifugal pump, comprising:

a pump housing defining pumping chamber means;

rotatable impeller means in the pumping chamber means and including a plurality of impeller blades designed for forming trailing vapor cavities within a liquid in the chamber means to generate low pressure regions behind the blades upon rotation of the impeller means;

fluid inlet means to the pumping chamber means radially inwardly of the low pressure regions and in communication therewith;

fluid outlet means from the pumping chamber means radially outwardly of the inlet means and in an area of the chamber means whereby the fluid can be pumped from the chamber means; and liquid inlet means to the pumping chamber means in the area of the impeller blades for flushing the low pressure regions behind the blades.

2. The centrifugal pump of claim 1 wherein said liquid inlet means are arranged in a direction generally tangential to the path of the rotating impeller blades.

3. The centrifugal pump of claim 2 wherein said liquid inlet means enter the chamber means in a direction opposite the direction of rotation of the impeller blades.

4. The centrifugal pump of claim 3 wherein said liquid inlet means include a plurality of liquid inlets about the impeller means.

5. The centrifugal pump of claim 4 wherein said plurality of liquid inlets are generally equally spaced about the axis of rotation of the impeller means.

6. The centrifugal pump of claim 1 wherein said fluid outlet means include a plurality of fluid outlets alternating between the plurality of liquid inlets.

7. The centrifugal pump of claim 1 wherein said fluid inlet means are located generally on the axis of rotation of the impeller means.

8. The centrifugal pump of claim 1 wherein said fluid outlet means are located radially outwardly of the impeller blades.

9. The centrifugal pump of claim 1 wherein said liquid inlet means include a plurality of liquid inlets about the impeller means.

10. The centrifugal pump of claim 9 wherein said fluid outlet means include a plurality of fluid outlets alternating between the plurality of liquid inlets.

11. The centrifugal pump of claim 1 wherein each impeller blade is generally ramp-shaped and inclined opposite the direction of rotation thereof.

12. The centrifugal pump of claim 11 wherein each ramp-shaped impeller blade includes an inclined outer wall terminating in a blade tip defined by a transverse distal edge of the inclined outer wall.

13. The centrifugal pump of claim 12 wherein each ramp-shaped impeller blade is a closed structure defining an internal chute in communication between the fluid inlet means and the respective low pressure region behind the blade.

14. The centrifugal pump of claim 13 wherein said fluid inlet means are located generally at the axis of rotation of the impeller means, and including an internal passage in the impeller means between the fluid inlet means and said chute.

15. The centrifugal pump of claim 1 wherein said pumping chamber is generally cylindrically shaped, and said liquid inlet means enters the chamber means through an outer cylindrical wall thereof radially outwardly of the impeller blades.

16. A cavitating centrifugal pump, comprising:

a pump housing defining a generally cylindrical pumping chamber means;

rotatable impeller means in the pumping chamber means and including a plurality of impeller blades designed for forming trailing vapor cavities within a liquid in the chamber means to generate low pressure regions behind the blades upon rotation of the impeller means;

fluid inlet means to the pumping chamber means generally on the axis of rotation of the impeller means and in communication with the low pressure regions behind the impeller blades;

fluid outlet means from the pumping chamber means radially outwardly of the inlet means and in an area of the pumping chamber means whereby the fluid can be pumped from the chamber means; and a plurality of liquid inlets to the chamber means through an outer cylindrical wall thereof radially outwardly of the impeller means for flushing the low pressure regions behind the blades.

17. The cavitating centrifugal pump of claim 16 wherein said liquid inlets are arranged in a direction generally tangential to the path of the rotating impeller blades.

18. The cavitating centrifugal pump of claim 17 wherein said liquid inlets each enter the chamber means in a direction opposite the direction of rotation of the impeller blades.

19. The cavitating centrifugal pump of claim 16 wherein said plurality of liquid inlets are generally equally spaced about the axis of rotation of the impeller means.

20. The cavitating pump of claim 19 wherein said fluid outlet means include a plurality of fluid outlets alternating between the plurality of liquid inlets.

21. The cavitating pump of claim 16 wherein each impeller blade is generally ramp-shaped and inclined opposite the direction of rotation thereof.

22. The cavitating pump of claim 21 wherein each ramp-shaped impeller blade includes an inclined outer wall terminating in a blade tip defined by a transverse distal edge of the inclined outer wall.

23. In a cavitating centrifugal pump which includes a housing defining a pumping chamber, rotatable impeller means in the pumping chamber and including a plurality of impeller blades which form trailing vapor cavities within a liquid in the chamber to generate low pressure regions behind the blades upon rotation of the impeller means, fluid inlet means to the pumping chamber generally on the axis of rotation of the impeller means, and fluid outlet means from the pumping chamber radially outwardly of the fluid inlet means whereby the fluid can be pumped from the chamber, the improvement comprising means communicating said low pressure regions behind the impeller blades with the fluid inlet means, and a plurality of liquid inlets to the chamber about the impeller means in the area of the impeller blades for flushing the low pressure regions behind the blades.

24. In a cavitating centrifugal pump as set forth in claim 23 wherein each of said liquid inlets is arranged in a direction generally tangential to the path of the rotating impeller blades.

25. In a cavitating centrifugal pump as set forth in claim 24 wherein each of said liquid inlets enters the pumping chamber in a direction opposite the direction of rotation of the impeller blades.

* * * * *